US005964657A

United States Patent [19]

Abe et al.

[11] Patent Number: 5,964,657

[45] Date of Patent: Oct. 12, 1999

[54] COIN PROCESSING DEVICE FOR AUTOMATIC VENDING MACHINES

[75] Inventors: Hiroshi Abe; Motoharu Kurosawa, both of Iwatsuki, Japan

[73] Assignee: Asahi Seiko Co., Ltd., Tokyo, Japan

[21] Appl. No.: 08/785,054

[22] Filed: Jan. 17, 1997

[30] Foreign Application Priority Data

Jan. 22, 1996 [JP] Japan ..... 8-042009

[51] Int. Cl.[6] ..... G07D 3/16

[52] U.S. Cl. ..... 453/3; 453/33; 453/57

[58] Field of Search ..... 453/3, 4, 5, 9, 453/11, 7, 17, 32, 33, 34, 35, 57, 20, 21, 40, 41, 49; 221/281; 194/350

[56] References Cited

U.S. PATENT DOCUMENTS

| | | | |
|---|---|---|---|
| 1,721,511 | 7/1929 | Donnellan | 453/34 |
| 4,172,462 | 10/1979 | Uchida et al. | 453/35 X |
| 4,752,274 | 6/1988 | Abe | 453/9 |
| 4,836,825 | 6/1989 | Smeets et al. | 453/40 |
| 5,462,480 | 10/1995 | Suzukawa | 453/49 |

FOREIGN PATENT DOCUMENTS

| | | |
|---|---|---|
| 6336040 | 2/1988 | Japan . |
| 6336040 | 7/1988 | Japan . |
| 1-188994 | 7/1989 | Japan . |

*Primary Examiner*—F. J. Bartuska
*Attorney, Agent, or Firm*—Price Gess & Ubell

[57] ABSTRACT

A coin processing apparatus for an automated vending machine includes a plurality of coin storing and dispensing units that receives appropriate coins from a distributor unit. A selector unit can determine a particular type of coin and direct it to a distributor unit. The coin storing and dispensing units are designed to provide for the bulk storage of coins and are compactly arranged to be mounted sequentially one above the other. Each of the coin storing and dispensing units can be rotated or moved in a horizontal direction to provide operator access.

37 Claims, 4 Drawing Sheets

COIN PROCESSING DEVICE FOR AUTOMATIC VENDING MACHINES

BACKGROUND OF THE INVENTION

1. Field of the Invention

The present invention pertains to a coin processing device for processing several different types of coins such as the type that is assembled into automatic vending machines and more particular, the present invention is directed to a compact and efficient coin processing device that provides ready access to the coins while maximizing storage capacities.

2. Description of Related Art

The necessity to process coins for making change is well understood in the automatic vending machine field and includes not only monetary coins, but other forms of tokens that are used, for example, in game arcade machines, etc. The coin processing devices not only determining the authenticity of the coin or token, but are further capable of providing change when the amount of money inserted into the machine is greater than the price of the product being purchased.

A coin processing device must have the capacity to store coins and to provide coins for making change. An operator of an automatic vending machine will initially charge the coin processing device with a supply of coins to ensure that subsequent users will be able to receive the proper change. The coins deposited by the users will also then become available for making change for subsequent users.

An example of a coin processing device for an automatic vending machine can be found in U.S. Pat. No. 4,106,610. This type of coin processing device utilizes several tubes arranged across the front surface of the coin processing device to enable the coins to be stacked and housed in the tubes for providing change. If it is desired to increase the number of coins, the tubes must be lengthened, which would require the heighth of the entire automatic vending machine to also be increased to accommodate the added capacity. As can be appreciated, there is a desire to minimize the volume within the housing of the automatic vending machine that is required by a coin processing devising. Increasing the length of the tubes is counter to this requirement. Additionally, the tubes are hollow and cylindrical with a slightly larger diameter than that of the coins and coins can generally only be inserted in a sequential one-by-one charging of the structure. Since the diameter of the tubes are larger than the diameter of the coins by a slight amount, it is sometimes difficult to insert the coins. In addition, the requirement of providing a slanted gap between the inner wall of the tubes and the input coins can have an undesirable result of coins sometimes clogging the coin dispensing device resulting in problems for the entire automatic vending machine.

Another example of a coin dispensing apparatus can be seen in U.S. Pat. No. 5,462,480.

Accordingly, there is still a desire to improve coin processing devices to permit a rapid and simple apparatus for supplying coins for making change that can accommodate the storage of a large amount of coins. There is also a desire to reduce the heighth of a coin processing device compared with the amount of coins being processed for making change, while ensuring that the maintenance of the coin processing device can easily be accomplished.

Finally, there is a desire to avoid any problems of clogging and to ensure that the storage of several different types of coins can be accommodated in a bulk configuration.

OBJECTS AND SUMMARY OF THE INVENTION

The present invention provides a coin processing devise for an automatic vending machine wherein individual coin storing and dispensing units dedicated to specific coins can be arranged in a compact configuration permitting the storage of coins in a bulk state.

The coin processing apparatus includes a plurality of coin storing and dispensing units, each dedicated to different types of coins in combination with a selector unit for determining a particular type of coin and a distributor unit that is connected to the selector unit for directing the particular type of coin to the appropriate coin storing and dispensing unit. The plurality of coin storing and dispensing units are mounted sequentially one above the other in a stacked, vertical arrangement to provide a compact configuration. Each of the coin storing dispensing units can have a hopper connected to the distribution unit so that its effective storage area is significantly larger in a horizontal direction than a diameter of the particular type of coin to enable a bulk storage of coins. The distributor unit may be dedicated to a specific coin storing and dispensing unit or may be collective positioned adjacent a selector unit with separate chutes connecting the distributor unit to the individual coin storing and dispensing units. Alternatively, the coin storing and dispensing units may be connected to a collective distributor unit by a common chute. The plurality of coin storing and dispensing units are mounted in a support assembly to provide a relative horizontal movement of the individual coin storing and dispensing units to permit operator access to the coins stored therein. An example of one form of support assembly would include a rotating shaft that permits pivotal movement of the individual coin storing and dispensing units from their vertical alignment outward from the stacked arrangement in a horizontal direction.

The coin processing device can be monitored to determine when the storage hoppers are filled and can direct coins to a safe box for storage. The user can deposit coins that will both be deposited within the hoppers and withdrawn from the hoppers for providing change.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings.

DETAILED DESCRIPTION OF THE PREFERRED EMBODIMENTS

The following description is provided to enable any person skilled in the art to make and use the invention and sets forth the best modes contemplated by the inventors of carrying out their invention. Various modifications. however, will remain readily apparent to those skilled in the art, since the general principles of the present invention have been defined herein specifically to provide coin processing apparatus for an automatic vending machine.

The present invention addresses a problem of meeting the requirements of a compact, but easily serviceable coin processing apparatus that can be mounted as an integral part of an automatic vending machine. The present invention will be described in operation with monetary coins, although it should be understood that other so called nominal coins, such as metal slugs, tokens and the like, which are similar in configuration to coins, can be used. For example, tokens are frequently sold for use in various forms of arcade games. In addition to general automatic vending machines, the present invention can also be used in conjunction with machines which dispense coins that are discharged through a coin return slot, such as bill and coin changers, token changers and video games.

The coin processing apparatus includes a selector unit which can preliminarily determine the authenticity of the coin and the type of coin and various forms of selector units are known in the art and will not be described in detail herein. For purposes of the present invention, the selector unit can receive a coin and process it to determine the type of coin and if the coin is false or not applicable, it can reject the coin appropriately. Additionally, the present invention utilizes a distributor unit that can work with the selector unit for directing a particular type of coin to an appropriate coin storing and dispensing unit. Again, various forms of distributing units are known in this industry and their operational details are therefore accordingly omitted from this specification.

Finally, coin storing and dispensing unit that can receive and store coins in bulk are also known and various types can be utilized or appropriately modified as long as they are capable of maximizing the storage of coins in a self-contained unit and are susceptible for mounting in not only a compact configuration, but also in a manner that permits the individual coin storing and dispensing unit to be moved for access by an operator.

Figure 1:
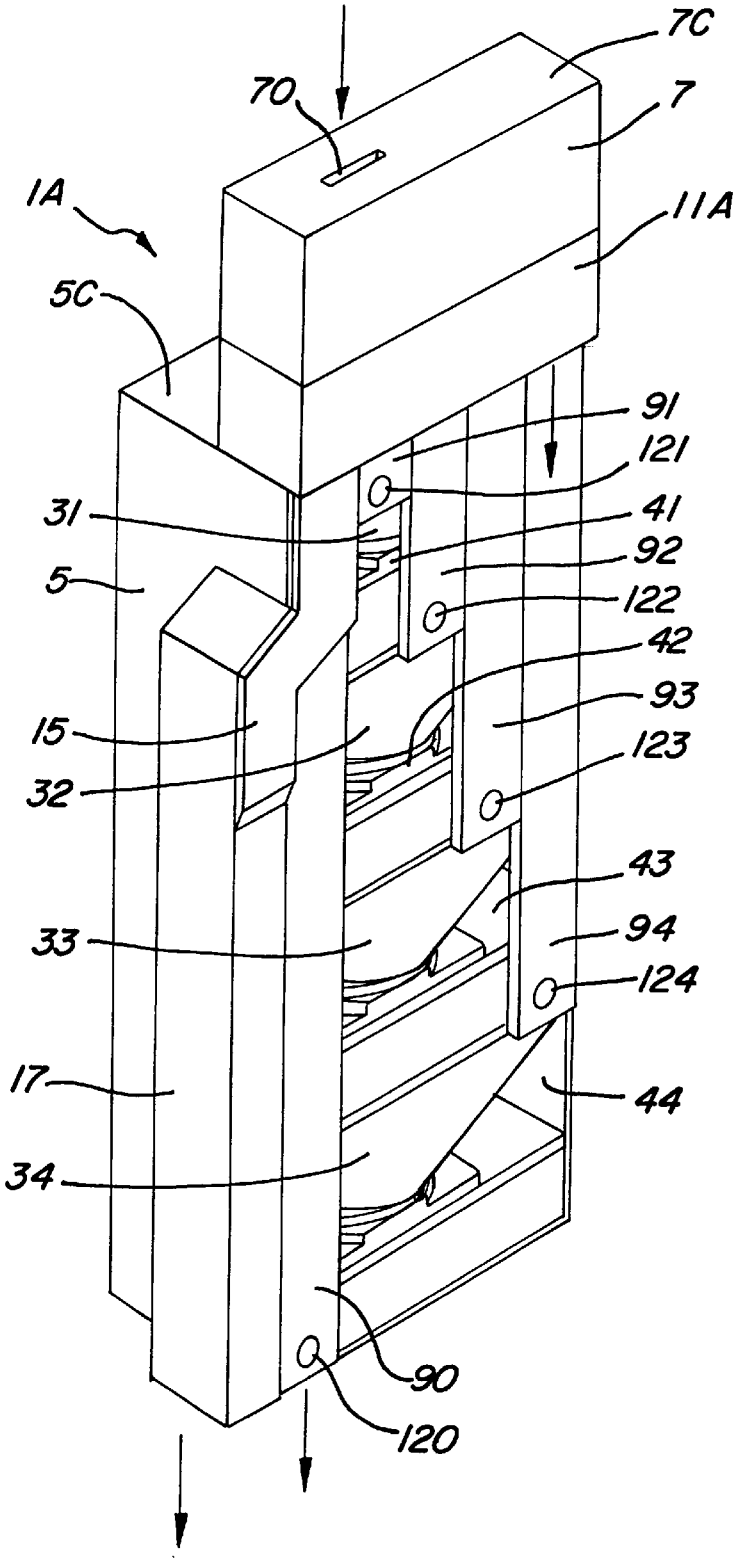
FIG. 1 is a prospective view of the coin processing apparatus of the present invention in a first embodiment.

Referring to FIG. 1, the first embodiment of the present invention is disclosed.

The coin processing device 1A can be functional divided into a lower large main device body 5 for supporting coin storing and dispensing units, an upper small selector unit 7 for determining the type of coins, and an intermediate small distribution unit 11A for distributing coins.

The coin selector unit 7 has a coin insertion slot 70 near the end of a top plate 7C. The coin insertion slot 70 receives coins which have been inserted into the coin slot of an automatic vending machine, which is not shown in the figure. The selector unit 7, for example, can electrically determine the authenticity of the coins and the type of coin, when the inserted coins naturally fall through an inclined passage.

In the selector unit 7, when it is determined that the coin is not authentic, the coin is sent to a cancel passage 15 through a chute, which is not shown in the figure. The cancel passage 15 communicates with a coin return slot of the automatic vending machine (not shown in the figure) through a passage 17 for pay-out. Also, in reference to the coin selector unit 7, various selector units are well known in the art, and further explanation is omitted here.

From the selector unit 7, an authentic coin output by naturally falling is selected according to its diameter, for instance, as it falls through an inclined passage of the distribution unit 11A mounted on a top plate 5C of the main device body 5. Also, in reference to the coin distribution unit 11 A, since various types of distributors are well known, further explanation will be omitted.

In FIG. 1, a 50-yen coin, which has the smallest diameter, is introduced into passage 94 through a drop hole, which is not shown in the figure, and a 100-yen coin, which has a diameter that is larger than the 50-yen coin, is similarly introduced into passage 93. A 10-yen coin, which is larger than the 100-yen coin is introduced into passage 92. A 500-yen coin, which is the largest coin, is introduced into passage 91.

Also, as for the coins currently used in Japan, there are six types including the 500-yen coin, 100-yen coin, 50-yen coin, 10-yen coin, 5-yen coin, and 1-yen coin; however, as for the coins typically used in automatic vending machines, etc., there are usually only four types, including the 10-yen coin or higher, in this application example, four types of coins are used.

For example, as will be mentioned later, there are four hopper devices or coin storing and dispensing units 31, 32, 33, and 34. Hopper device 31 is used for 500-yen coins and hopper device 32 is used for 10-yen coins. Hopper device 33 is used for 100-yen coins and hopper device 34 is used for 50-yen coins.

The lower large main device body 5 of FIG. 1 is vertically divided into four separate compartments 41, 42, 43, and 44, and in each compartment 41 through 44, the respective hopper devices 31 through 34 are provided for storage of coins so they can be freely filled and emptied by a maintenance operator of the vending machine.

The individual hopper devices 31–34, which can store coins, can be seen in Japanese Kokoku Patent No. Sho 63-36040 (1988) and, in particular, Japanese Kokai Patent Application No. Hei 8-110960 (1996).

Figure 2:
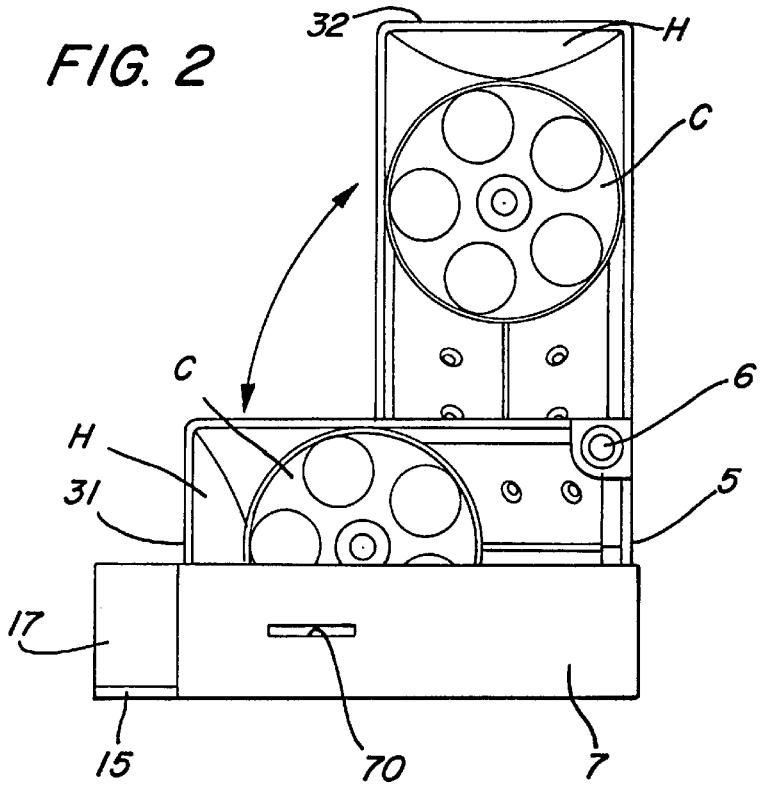
FIG. 2 is a plan view of FIG. 1 with one of the coin storing and dispensing units rotated horizontally out of the vertical stack.
Figure 5:
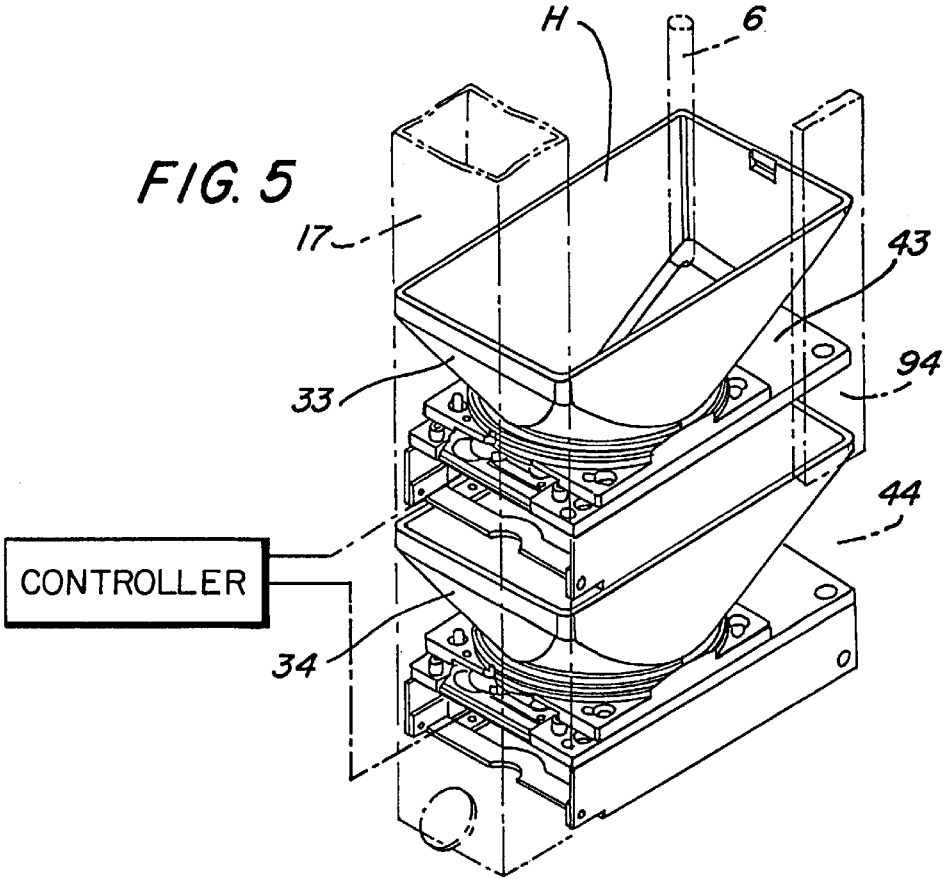
FIG. 5 is a partial perspective view of a coin storing and dispensing unit that can be used in the present invention.

Briefly speaking, the hopper devices, as shown in FIG. 2 and FIG. 5, are coin transmitting devices which house several coins in a container H with a large opening and transmit a prescribed number of coins to a desired external place as needed from the above-mentioned container H by the rotation of a disk C with a guide hole for the coins, as can be seen in FIG. 2.

Therefore, if an instruction signal indicating the amount of change is transmitted to each hopper device 31–34 from a controller (shown in FIG. 5) of the automatic vending machine, each hopper device 31–34 can pay out the necessary number of coins based on the change to be made.

In this application example, for example, if the change is 680 yen, one 500-yen coin, one 100-yen coin, one 50-yen coin, and three 10-yen coins are paid out to the passage 17 from each hopper 31–34. The passage 17 communicates with a dispensing tray of the vending machine. Also, needless to say, the frequently used hopper device 32 for 10-yen coins can also be made large, and the lowest compartment 44 can be made large. Furthermore, hopper device 32 can be arranged in compartment 44, and the passage 92 can be extended downward. In this case, the hopper device 31 for 500-yen coins is used less frequently and it can be made small, and compartment 41 can also be made small. Furthermore, the hopper device 34 for 50-yen coins, which have a small diameter, can also be made small and arranged in a small compartment 42. Also, to accommodate the currency in foreign countries, the number of hopper devices 31–34 may be changed in accordance with the situation of the coins used, in that country.

The hopper devices 31–34, which constitute a storage portion, as seen from FIG. 2, can be rotated clockwise in a horizontal direction in the figure around the main device body 5 via a vertical rotating shaft 6 installed at one corner of the main device body 5, so that the individual coin storing and dispensing units can be pulled out. In other words, the hopper devices 31–34 can be loaded and unloaded to and from the main device body 5.

Therefore, the hopper devices 31–34, for example, may be constituted such that they are loaded and unloaded like a Japanese chest of drawers.

As shown in FIG. 1, each coin hopper device 31–34 respectively communicates with its corresponding passage 91–94, and coins dropping from each of passages 91–94 are respectively stored. Each hopper device 31–34 stores one type of coin.

Also, in passage 90, when any of the hopper devices 31–34 is full, that is, all the upper openings of the passages 91–94 are closed, the coins can be housed in a safe box in the automatic vending machine, which is not shown in the figure.

Sensors 120, 121, 122, 123, and 124, which are coin detectors, are respectively arranged at the lower side of each of passages 90–94 as shown in FIG. 1. These sensors 120–124 can detect the passage of coins. Therefore, the number of coins for making change, which are filled in each hopper device 31–34 and arranged in a bulk state, is counted and input into a controller, such as a CPU, which is not shown in the figure, and the number of coins paid out of each hopper device 31–34 is confirmed by the controller. At the same time, the number of coins received in each hopper device 31–34 via passages 91–94 is confirmed by each sensor 121–124. Thus, in the controller, which is not shown in the figure, the number of coins inside each hopper device 31–34 can always be counted. In addition, the number of coins in the safe box sent from passage 90, which is not shown in the figure, is obtained from the controller, by a signal indicating the types of coin obtained from the selector unit 7 and a signal is generated by sensor 120.

Figure 3:
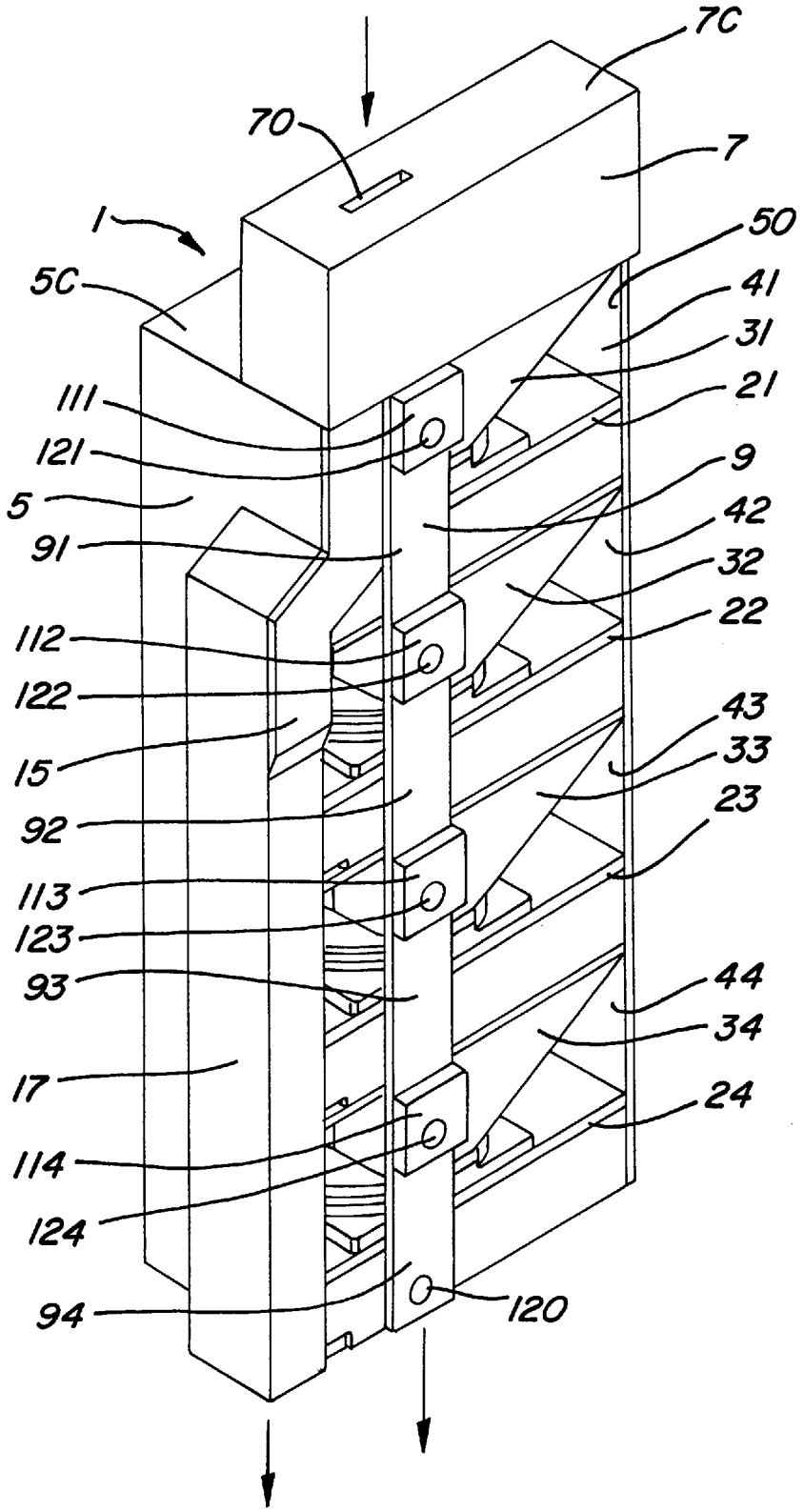
FIG. 3 is a perspective view of an alternative embodiment of the present invention.

In a second embodiment of the present invention, as shown in FIG. 3, the coin processing device 1 is formed in the shape of an organizer box used in a Japanese household. In other words, there is a main device body 5 in which at least one side surface has an opening 50 and which is vertically partitioned by partitioning plates 21, 22, 23, and 24 to divide the main device body 5 into several compartments 41, 42, 43, and 44. In the above-mentioned compartments 41–44 in the main device body 5, the hopper devices 31, 32, 33, and 34 act as several storage units, which can store coins prepared for making change in a bulk state and can communicate with a change coin return slot (not shown in the figure) of the automatic vending machine.

In the top plate 5C of the main device body 5, the box-shaped selector unit 7 for determining the authenticity of the coins and types of coins, that have been input through the coin insertion slot (not shown in the figure) of the automatic vending machine, is installed. Also, in FIG. 3, 70 represents the insertion slot in the top plate 7C of the selector unit 7 and is an inlet for putting coins into the selector unit 7, and needless to say, it communicates with the coin insertion slot of the automatic vending machine, which is not shown in the figure.

The authenticity of the coins is determined by the selector unit 7, and a common passage 9 for guiding the coins to the hopper devices 31–34 is installed such that it extends in the vertical direction in the vicinity of the side surface edge of the main device body 5 from the vicinity of the end of the bottom surface of the selector unit 7. In passage 9, distribution parts 111, 112, 113, and 114 for distributing to hopper devices 31–34, the specific types of coins determined by the particular type of selector unit 7 for each type of coin, are arranged in the above-mentioned compartments 41–44. Also, as seen from FIG. 3, connecting branch passages 91, 92, 93, and 94 for connecting the selector unit 7 and each distribution part 111–114 constitute the passage 9. Branch passage 94, at the lowest end of the common passage 9 shown in FIG. 3, communicates with a safe box in the automatic vending machine, which is a recovery box and is not shown in the figure. The distribution parts 111–114 are respectively equipped with sensors 121, 122, 123, and 124 as detecting means. These sensors 121–124 detect the state in which types of coins are input to each hopper device 31–34, and as a result, they can be used to count the number of coins stored in each hopper device 31–34. Also, for example, if the sensors 121–124 detect the amount or volume of the coins stored in each hopper device 31–34, whether or not the number of coins stored in each hopper device 31–34 has reached a prescribed storage limit can be determined.

Figure 4:
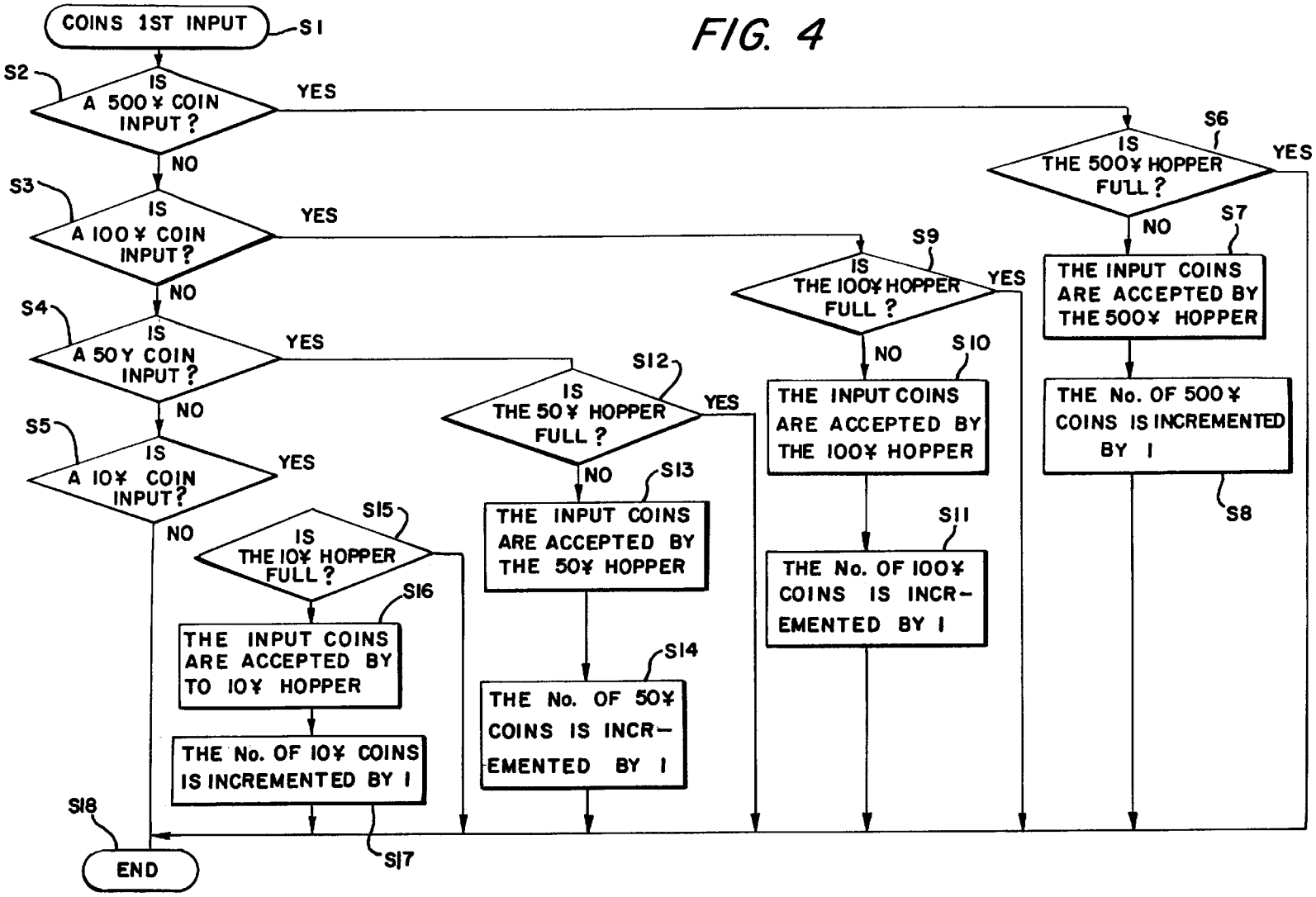
FIG. 4 is a flow chart setting forth an algorithm of the operation of the present invention.

In this case, the distribution parts 111–114 can be kept from operating, and the coins determined as a certain type beyond the storage limit can be guided to a recovery box (not shown in the figure) for coins via the branch passage 94. At the lowest part of the branch passage 94, there is installed a coin sensor 120 for detecting coins going through the branch passage 94 to the recovery box. A coin cancel passage 15 can directly guide those coins determined as inappropriate, such as counterfeit coins, to a change coin return slot (not shown in the figure) of the automatic vending machine. Therefore, the cancel passage 15 communicates with the passage 17 for payment, which communicates with the change coin return slot (not shown in the figure) of the automatic vending machine. The operation of the coin processing device 1 of the above-mentioned embodiment will be explained below with reference to FIG. 4. When coins are put into the automatic vending machine, which is not shown in the figure, the operation of the coin processing device 1 is started (step S1). When coins enter the selector unit 7, the authenticity of the input coins is determined. In other words, the type of coin is determined (steps S2, S3, S4, and S5). Therefore, coins other than the four acceptable types of coins are determined to be counterfeit coins and returned to the change coin return slot of the automatic vending machine, which is not shown in the figure, through the cancel passage 15 and passage 17, and the operation of the coin processing device 1 is finished (step S18).

If the coins entering the selector unit 7 are determined to be 500-yen coins (step S2), whether or not the hopper device 31 for 500-yen coins is full is determined by a controller, which is not shown in the figure (step S6). If the hopper device is full, that is, if the number of 500-yen coins stored in the hopper device 31 has reached the prescribed number, which is the storage limit, the distribution parts 111–114 do not operate, and the 500-yen coins drop from the top to the bottom through passage 9 to the coin recovery box, which is not shown in the figure. Then, the operation of the machine is finished (step S18).

If the hopper device is not full, that is, if the number of 500-yen coins stored in the hopper device 31 has not reached the limit, the distribution part 111 operates, and the 500-yen coins can be accepted in the hopper device 31 (step S7). At that time, the 500-yen coins are detected by the sensor 121, and the number of 500-yen coins is incremented by 1 (step S8). In other words, the numerical value indicating number of coin, currently stored in the hopper device 31, is incremented by 1 in the controller by a signal sent from sensor 121. Also, in this case, needless to say, the number of 500-yen coins input in a bulk state into the hopper device 31 is input to the controller, which is not shown in the figure.

If the coins entering the selector unit 7 are determined to be 100-yen coins (step S3), whether or not the hopper device 32 for 100-yen coins is full is determined by the controller, which is not shown in the figure (step S9). If the hopper device is full, that is, if the number of 100-yen coins stored in the hopper device 32 has reached the prescribed number, which is the storage limit, the distribution parts 111–114 do not operate, and the 100-yen coins drop from the top to the bottom through passage 9 to the coins recovery box, which is not shown in the figure. Then, the operation of the machine is finished (step 18).

If the hopper device is not full, that is, if the number of 100-yen coins stored in the hopper device 32 has not reached the limit, distribution part 112 operates, and the 100-yen coins can be accepted by the hopper device 32 (step S10). At that time, the 100-yen coins are detected by the sensor 122, and the number of 100-yen coins is incremented by 1 (step S11). In other words, the numerical value indicating the number of coins, currently stored in the hopper device 32 is incremented by 1 in the controller by a signal from sensor 122. Also, in this case, needless to say, the number of 100-yen coins input in a bulk state into the hopper device 32 is input to the controller, which is not shown in the figure. Similarly, if the coins entering the selector unit 7 are determined to be 50-yen coins (step S4), whether or not the hopper device 33 for 50-yen coins is full is determined by the controller (step S12).

If the hopper device is full, the distribution parts 111–114 do not operate, and the 50-yen coins drop from the top to the bottom through the passage 9 to the coin recovery box, which is not shown in the figure. Then, the operation of the machine is finished (step 18). If the hopper device is not full, distribution part 113 operates, and the 50-yen coins can be accepted by the hopper device 33 (step S13). At that time, the 50-yen coins are detected by the sensor 123, and the number of 50-yen coins is incremented by 1 (step S14). Similarly, if the coins entering the selector unit 7 are determined to be 10-yen coins (step S5), whether or not the hopper device 34 for 10-yen coins is full is determined by the controller (step S15). If the hopper device is full, the distribution parts 111–114 do not operate, and the 10-yen coins drop from the top to the bottom through the passage 9 to the coin recovery box, which is not shown in the figure. Then, the operation of the machine is finished (step 18). If the hopper device us not full, distribution part 114 operates, and the 10-yen coins can be accepted by the hopper device 34 (step S16). At that time, the 10-yen coins are detected by the sensor 124, and the number of 10-yen coins is incremented by 1 (step S17). Thus, the distribution of coins is carried out.

On the other hand, an operation for payment of coins is carried out by sending an instruction signal from the controller assembled in the main body of the automatic vending machine, which is not shown in the figure, for each hopper device 31–34 and paying out the prescribed amount of coins. For example, for 680-yen of change, one 500-yen coin, one 100-yen coin, one 50-yen coin, and three 10-yen coins are respectively paid by each hopper device 31–34. Also, in regard to the difference between the coin processing device 1A of the first application example shown in FIG. 1 and that of the second embodiment, first, the functioning of the several distribution parts 111–114 of the first embodiment is the same as that of the second embodiment, and the distribution part 11A, which is housed in the same box as the selector unit 7, is arranged between the selector unit 7 and the main machine body 5. Next, the passages 91–94 extending to each hopper device 31–34 from the distribution part 11A are installed.

These points are the main differences, and the remainder are similar to the first embodiment. Thus, the same reference numerals are used to indicate the same parts, and further explanation of those parts will be omitted here.

Also, distribution unit 11A is omitted in FIG. 3; however, the distribution units corresponding to distribution units 111–114 are still furnished in the second application example, and if the distribution units corresponding to distribution units 111–114 are assumed as distribution units 11A1–11A4 (not shown in the figure), the passages 91–94 are respectively connected to each distribution unit 11A1–11A4.

Also, the passage 90 is arranged adjacent and parallel to passage 17 in the first application example, and as mentioned above, the upper openings of the passages 91–94 are respectively connected to the upper opening of passage 90.

The coin processing device of the present invention can be assembled into an automatic vending machine and is equipped with several coin storage and dispensing units which can hold coins prepared for making change in a bulk state, and can pass change coins to the return slot of the automatic vending machine. A selector unit is provided which determines the authenticity of the coins entering the coin insertion slot of the automatic vending machine, and a distribution unit distributes the coin types determined by the selector unit to the above-mentioned storage units for each type of coin.

In the "storage unit" in this specification, the coins are not stacked one-by-one in tubes, and since several coins can be collectively stored in a bulk state, in any storage unit, its size is determined according to the number of coins to be stored.

As the "selector unit" of the present invention, any selector unit that can determine whether or not the input coin should be accepted and the type of coin may be used, and for example, there are mechanical selectors, electronic selectors, optical selectors, etc.

Furthermore, the coin processing device is equipped with a detecting means for detecting the state in which types of coins are discharged from the above-mentioned storage unit and the number of coins stored in the above-mentioned storage unit, and guiding the coins toward the coin recovery box without operating the above-mentioned distribution unit when the number of coins stored in the storage part has reached the prescribed limit.

The "detectors" of this specification can be constituted of a photosensor and CPU (central processing unit), for adding the number of newly input coins and subtracting the number of coins paid out, so that the number of coins stored in the storage units is always known. If newly input coins cause the number of coins that can be stored in the storage unit to be exceeded, the new coins are not accepted by the storage part and are guided to the coin recovery box.

Furthermore, the coin processing device is equipped with a passage which connects the above-mentioned coin insertion slot, selector unit, distribution unit, and storage unit with a passage that connects the above-mentioned storage unit and change coin return slot, a cancel passage that directly guides the coins determined to be a certain type to the above-mentioned change coin return slot, and a recovery passage that directly guides the types determined by the above-mentioned selector unit to the recovery box.

The storage unit of the main device body can be opened and closed like a drawer in the main device body. In the drawer of this specification, for example, there are drawers of a chest or the storage unit of the main machine body which are pulled out, and pushed around a specific rotating shaft, etc.

In other words, if the storage unit of the main device body is constituted such that it can be opened and closed, any compact storage unit that can be so mounted could be considered for use.

Therefore, according to the coin processing device of the present invention, since the storage unit of the main device body can be opened and closed like a drawer, when an operator of the machine stores coins in the storage unit, the storage unit is drawn from the main device body and returned after the coins have been stored. Thus, its handling is very convenient. Also, since the storage unit can store coins prepared for making change in a bulk state, its opening is significantly large compared to the size of the coins. Therefore, trouble caused by clogging can be prevented.

Furthermore, as the height of the hopper devices 31–34 is reduced, if the opening is made comparatively larger with respect to the height, the capacity does not change, even with a low height. Therefore, several coins can be easily stored in a bulk state for making change, and the height of the device can also be reduced. Also, the opening of the storage unit has a size that allows several tens or hundreds of coins to be input at a time.

According to the coin processing devices 1 and 1A of FIGS. 1 and 3, since the hopper devices 31–34 of the main device body 5 can be opened and closed like a drawer, when an operator of the device stores coins in the hopper devices 31–34, the hopper devices can be pulled out from the main device body 5 and returned after the coins have been stored. Thus, their handling is very convenient.

Furthermore, as the height of the hopper devices 31–34 is reduced, if the opening is made comparatively larger with respect to the height, the capacity does not change, even at a low height. Therefore, several coins can be easily stored in a bulk state for making change, and the height of the machine canalso be reduced. Also, the opening of the storage unit has a size that allows several tens or hundreds of coins to be input at a time.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. A coin processing apparatus for an automatic vending machine having a controller to provide instruction signals to dispense coins comprising:

a plurality of coin storing and dispensing units for different types of coins, each unit capable of storing in a bulk state and for dispensing a specific type of coin and being driven independently by an instruction signal from the controller;

a selector unit for determining a particular type of coin; and a distributor unit connected to the selector unit for directing a particular type of coin to an appropriate coin storing and dispensing unit, the plurality of coin storing and dispensing units being mounted sequentially one above the other in a vertical alignment to provide a compact configuration.

2. The invention of claim 1 wherein each coin storing and dispensing unit has a hopper connected to the distributor unit, the hopper having an effective storage area significantly larger in a horizontal direction than a diameter of the particular type of coin stored in the hopper.

3. The invention of claim 1 wherein each coin storing and dispensing unit is connected to the distributor unit by a respective separate chute that is approximately parallel to the other chutes.

4. The invention of claim 1 wherein each coin storing and dispensing unit is connected to the distributor unit by a common chute.

5. The invention of claim 1 further including a sensor unit for each coin storing and dispensing unit to count the coins entering the respective coin storing and dispensing unit.

6. The invention of claim 1 further including a support assembly for mounting each coin storing and dispensing unit to provide a relative horizontal movement of the individual coin storing and dispensing units to provide operator access to the coins stored therein.

7. The invention of claim 6 wherein the support assembly includes a rotating shaft to permit pivotal movement of individual coin storing and dispensing units from their vertical alignment in a horizontal direction.

8. The invention of claim 6 wherein each coin storing and dispensing unit has a hopper connected to the distributor unit, the hopper having an effective storage area significantly larger in a horizontal direction than a diameter of the particular type of coin stored in the hopper.

9. The invention of claim 6 wherein each coin storing and dispensing unit is connected to the distributor unit by a respective separate chute that is approximately parallel to the other chutes.

10. The invention of claim 6 wherein each coin storing and dispensing unit is connected to the distributor unit by a common chute.

11. In a coin processing apparatus for an automatic vending machine having a selector unit for determining a particular type of coin and a distributor unit connected to the selector unit, the improvement comprising:

a plurality of coin storing and dispensing units connected to the distributor unit, each coin storing and dispensing unit capable of storing in a bulk state and dispensing a specific type of coin;

a single dispensing passageway that is connected to each storing and dispensing unit to direct coins from each storing and dispensing unit to a common dispensing tray of the vending machine; and a support assembly for movably mounting each coin storing and dispensing unit so that they are operatively arranged sequentially one above the other in a vertical alignment to provide a compact configuration while storing and dispensing coins and can be individually moved out of the vertical alignment in a horizontal movement to provide operator access to the coins stored in a specific coin storing and dispensing unit.

12. The invention of claim 11 wherein each coin storing and dispensing unit includes a hopper connected to the distributor unit.

13. The invention of claim 12 wherein each coin storing and dispensing unit is pivotally mounted in the support assembly.

14. The invention of claim 11 wherein each coin storing and dispensing unit is connected to the distributor unit by a respective separate chute that is approximately parallel to the other chutes.

15. The invention of claim 11 wherein each coin storing and dispensing unit is connected to the distributor unit by a common chute.

16. The invention of claim 11 further including a sensor unit for each coin storing and dispensing unit to count the coins entering the respective coin storing and dispensing unit.

17. A coin processing apparatus for an automatic vending machine comprising:

a plurality of coin storing and dispensing units for different types of coins, each unit capable of storing in a bulk state and dispensing a specific type of coin;

a selector unit for determining a particular type of coin; and a distributor unit connected to the selector unit for directing a particular type of coin to an appropriate coin storing and dispensing unit, the plurality of coin storing and dispensing units being mounted sequentially one above the other in a vertical alignment to provide a compact configuration, wherein each coins storing and dispensing unit is connected to the distributor unit by a common chute.

18. The invention of claim 17 further including a sensor unit for each coin storing and dispensing unit to count the coins entering the respective coin storing and dispensing unit.

19. The invention of claim 17 further including a support assembly for mounting each coin storing and dispensing unit to provide a relative horizontal movement of the individual coin storing and dispensing units to provide operator access to the coins stored therein.

20. The invention of claim 19 wherein the support assembly includes a rotating shaft to permit pivotal movement of individual coin storing and dispensing units from their vertical alignment in a horizontal direction.

21. The invention of claim 19 wherein each coin storing and dispensing unit has a hopper connected to the distributor unit, the hopper having an effective storage area significantly larger in a horizontal direction than a diameter of the particular type of coin stored in the hopper.

22. A coin processing apparatus for an automatic vending machine comprising:

a plurality of coin storing and dispensing units for different types of coins, each unit capable of storing and dispensing a specific type of coin;

a selector unit for determining a particular type of coin;

a distributor unit connected to the selector unit for directing a particular type of coin to an appropriate coin storing and dispensing unit, the plurality of coin storing and dispensing units being mounted sequentially one above the other in a vertical alignment to provide a compact configuration; and a sensor unit for each coin storing and dispensing unit to count the coins entering the respective coin storing and dispensing unit.

23. The invention of claim 22 wherein each coin storing and dispensing unit is connected to the distributor unit by a respective separate chute that is approximately parallel to the other chutes.

24. The invention of claim 22 further including a support assembly for mounting each coin storing and dispensing unit to provide a relative horizontal movement of the individual coin storing and dispensing units to provide operator access to the coins stored therein.

25. The invention of claim 24 wherein the support assembly includes a rotating shaft to permit pivotal movement of individual coin storing and dispensing units from their vertical alignment in a horizontal direction.

26. The invention of claim 22 wherein each coin storing and dispensing unit has a hopper connected to the distributor unit, the hopper having an effective storage area significantly larger in a horizontal direction than a diameter of the particular type of coin stored in the hopper.

27. A coin processing apparatus for an automatic vending machine comprising:

a plurality of coin storing and dispensing units for different types of coins, each unit capable of storing and dispensing a specific type of coin;

a selector unit for determining a particular type of coin;

a distributor unit connected to the selector unit for directing a particular type of coin to an appropriate coin storing and dispensing unit, the plurality of coin storing and dispensing units being mounted sequentially one above the other in a vertical alignment to provide a compact configuration; and a support assembly for mounting each coin storing and dispensing unit to provide a relative horizontal movement of the individual coin storing and dispensing units to provide operator access to the coins stored therein, wherein the support assembly includes a rotating shaft to permit pivotal movement of individual coin storing and dispensing units from their vertical alignment in a horizontal direction.

28. The invention of claim 27, wherein each coin storing and dispensing unit is connected to the distributor unit by a respective separate chute that is approximately parallel to the other chutes.

29. The invention of claim 27, wherein each coin storing and dispensing unit is connected to the distributor unit by a common chute.

30. In a coin processing apparatus for an automatic vending machine having a selector unit for determining a particular type of coin and a distributor unit connected to the selector unit, the improvement comprising:

a plurality of coin storing and dispensing units connected to the distributor unit, each coin storing and dispensing unit capable of storing and dispensing a specific type of coin; and a support assembly for movably mounting each coin storing and dispensing unit so that they are operatively arranged sequentially one above the other in a vertical alignment to provide a compact configuration while storing and dispensing coins and can be individually moved out of the vertical alignment in a horizontal movement to provide operator access to the coins stored in a specific coin storing and dispensing unit, wherein each coin storing and dispensing unit is pivotally mounted in the support assembly.

31. The invention of claim 30, wherein each coin storing and dispensing unit is connected to the distributor unit by a respective separate chute that is approximately parallel to the other chutes.

32. The invention of claim 30, wherein each coin storing and dispensing unit is connected to the distributor unit by a common chute.

33. The invention of claim 30 further including a sensor unit for each coin storing and dispensing unit to count the coins entering the respective coin storing and dispensing unit.

34. In a coin processing apparatus for an automatic vending machine having a selector unit for determining a particular type of coin and a distributor unit connected to the selector unit, the improvement comprising:

a plurality of coin storing and dispensing units connected to the distributor unit, each coin storing and dispensing unit capable of storing in a bulk state and dispensing a specific type of coin; and a support assembly for movably mounting each coin storing and dispensing unit so that they are operatively arranged sequentially one above the other in a vertical alignment to provide a compact configuration while storing and dispensing coins and can be individually moved out of the vertical alignment in a horizontal movement to provide operator access to the coins stored in a specific coin storing and dispensing unit, wherein each coin storing and dispensing unit is connected to the distributor unit by a common chute.

35. The invention of claim 34, wherein each coin storing and dispensing unit is pivotally mounted in the support assembly.

36. The invention of claim 34 further including a sensor unit for each coin storing and dispensing unit to count the coins entering the respective coin storing and dispensing unit.

37. In a coin processing apparatus for an automatic vending machine having a selector unit for determining a particular type of coin and a distributor unit connected to the selector unit, the improvement comprising:

a plurality of coin storing and dispensing units connected to the distributor unit, each coin storing and dispensing unit capable of storing and dispensing a specific type of coin;

a support assembly for movably mounting each coin storing and dispensing unit so that they are operatively arranged sequentially one above the other in a vertical alignment to provide a compact configuration while storing and dispensing coins and can be individually moved out of the vertical alignment in a horizontal movement to provide operator access to the coins stored in a specific coin storing and dispensing unit; and a sensor unit for each coin storing and dispensing unit to count the coins entering the respective coin storing and dispensing unit.

* * * * *